US005759760A

United States Patent [19]

Lushington et al.

[11] Patent Number: 5,759,760

[45] Date of Patent: Jun. 2, 1998

[54] AQUEOUS SOLID PARTICLE DISPERSIONS IN CHEMICAL SENSITIZATION

[75] Inventors: Kenneth J. Lushington, Rochester; John W. Boettcher, Webster; Henry J. Gysling, Rochester, all of N.Y.

[73] Assignee: Eastman Kodak Company, Rochester, N.Y.

[21] Appl. No.: 869,136

[22] Filed: Jun. 4, 1997

[51] Int. Cl.[6] ..... G03C 1/09

[52] U.S. Cl. ..... 430/603; 430/569; 430/599; 430/600; 430/601; 430/605

[58] Field of Search ..... 430/599, 600, 430/601, 603, 605, 569

[56] References Cited

U.S. PATENT DOCUMENTS

| | | | |
|---|---|---|---|
| 2,448,060 | 8/1948 | Smith et al. | 430/603 |
| 2,540,086 | 2/1951 | Baldsiefen et al. | 430/603 |
| 2,598,079 | 5/1952 | Stauffer et al. | 430/603 |
| 3,297,446 | 1/1967 | Dunn | 430/550 |
| 3,297,447 | 1/1967 | McVeigh | 430/543 |
| 4,092,171 | 5/1978 | Bigelow | 430/550 |
| 4,144,062 | 3/1979 | Lelental et al. | 430/353 |
| 4,152,155 | 5/1979 | Lelental et al. | 430/353 |
| 4,188,218 | 2/1980 | Gysling | 430/495 |
| 4,251,623 | 2/1981 | Gysling | 430/353 |
| 4,258,128 | 3/1981 | Gysling | 430/413 |
| 5,049,484 | 9/1991 | Deaton | 430/605 |
| 5,049,485 | 9/1991 | Deaton | 430/605 |
| 5,112,733 | 5/1992 | Ihama | 430/603 |
| 5,217,859 | 6/1993 | Boettcher et al. | 430/569 |
| 5,220,030 | 6/1993 | Deaton | 548/105 |
| 5,248,588 | 9/1993 | Nagaoka | 430/605 |
| 5,252,455 | 10/1993 | Deaton | 430/605 |
| 5,391,727 | 2/1995 | Deaton | 540/1 |
| 5,422,232 | 6/1995 | Asami et al. | 430/533 |
| 5,424,178 | 6/1995 | Tsuzuki | 430/523 |
| 5,429,916 | 7/1995 | Ohshima | 430/538 |
| 5,536,632 | 7/1996 | Wen et al. | 430/567 |
| 5,620,841 | 4/1997 | Lok et al. | 430/600 |
| 5,677,120 | 10/1997 | Lushington et al. | 430/603 |

FOREIGN PATENT DOCUMENTS

| | | |
|---|---|---|
| 0 368 304 B1 | 5/1990 | European Pat. Off. . |
| 0 541104 A1 | 5/1993 | European Pat. Off. . |
| 0 661 589 A1 | 7/1995 | European Pat. Off. . |
| 1396696 | 6/1975 | United Kingdom . |

OTHER PUBLICATIONS

Denko et al, Synthesis of Organic Compounds of Gold, Dec. 1945, p. 2241.

Akerstrom, ARKIV FOR KEMI Band 14 nr 35, May 1959, pp. 387–401.

Farrell et al, Inorganic Chemistry, vol. 10, No. 8, Feb. 1971, pp. 1606–1610.

Marcotrigiano et al, Inorg. Nucl. Chem. Letters, vol. 4, 1972, pp. 399–402.

Hesse et al, Chemica Scandinavica, vol. 26, No. 10, 1972, pp. 3855–3864.

Lawton et al, Inorganic Chemistry, vol. 1, No. 9, 1972, pp. 2227–2233.

Bonati et al, Gazzetta Chimica Italiana, vol. 103, 1973, pp. 373–386.

Harbison et al, The Theory of the Photographic Process, Chapter 5, 1977, pp. 149–158.

Chiari et al, "Gold Dithiocarboxylates", Inorganic Chemistry, vol. 24, No. 3, 1985, pp. 366–371.

Miller et al, Synth. React. Inorg. Met.-Org. Chem., 15(2), 1985, pp. 223–233.

Schuerman et al, Journal of the American Chemical Society, 1986, 108, pp. 336–337.

(List continued on next page.)

*Primary Examiner*—Hoa Van Le

*Attorney, Agent, or Firm*—Paul A. Leipold

[57] ABSTRACT

The invention is generally accomplished by providing a method of chemical sensitization comprising providing a silver halide emulsion, and adding to the silver halide emulsion aqueous solid particle dispersion of a chemical sensitizing agent having a water and organic solvent insolubility (i.e., 50 mg/100 ml or less), and heating said emulsion wherein said chemical sensitizing agent comprises at least one member selected from the group consisting of gold compounds represented by Formula I:

$$\{AuS_2X\}_n \qquad \text{I}$$

wherein

X is $PR_2$ (dithiophosphinates), $P(OR)_2$ (dithiophosphates), COR (xanthates), $CNR_2$ (dithiocarbamates), CR (dithiocarboxylates)

R is alkyl or aryl n=1–6, tellurium compounds represented by Formula II:

$$TeL_nX_2$$

wherein

L is thiourea or substituted thiourea, n is 2 or 4,

X is Cl, Br, I, OCN, SCN, SeCN, TeCN, or $N_3$ and

Formula IIA

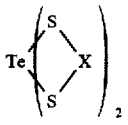

wherein

X is COR, CSR, $CNR_2$, CR, CAr, $PR_2$, $P(OR)_2$, $(PR_2)_2N$

R is alkyl or aryl, and palladium compounds represented by Formula III:

$$PdX_2(TeR_2)_2$$

wherein

X is Cl, Br, I, NCO, NCS, NCSe, NCTe, or $N_3$

R is alkyl or aryl.

12 Claims, No Drawings

OTHER PUBLICATIONS

Foss et al, Acta Chemica Scandinavica A41, 1987, pp. 310–320.

Foss et al, Acta Chemica Scandinavica A41, 1987, pp. 321–327.

Siasios et al, Crystal Structure of Catena–bis–(diphenyl dithiophospinato)–digold(Au—Au), $C_{12}H_{10}AuPS_2$, 1995, p. 210.

Kawasaki et al, The Journal of Photographic Science, vol. 43, 1995, pp. 122–130.

Research Disclosure 37018, Feb. 1995, pp. 60–61.

Research Disclosure 37154, Mar. 1995, p. 227.

Al–Sa'Ady et al, Inorganic Syntheses, vol. 23, A General Synthesis for Gold(I) Complexes, No. 39, pp. 191–193.

Uson et al, Inorganic Syntheses, vol. 26, (Tetrahydrothiophene)Gold(I) or Gold(III) Complexes, No. 17, pp. 85–86.

AQUEOUS SOLID PARTICLE DISPERSIONS IN CHEMICAL SENSITIZATION

FIELD OF THE INVENTION

This invention relates to compounds utilized in chemical sensitization of silver halide compounds and a method of introducing said compounds into such emulsions. It particularly relates to the preparation of aqueous solid particle dispersions of such sensitizer compounds and introduction of said dispersions into silver halide emulsions followed by heating the resulting emulsion at some elevated temperature for a given length of time to chemically sensitize the emulsions.

BACKGROUND OF THE INVENTION

Photographic silver halide materials are often chemically sensitized with one or more compounds containing labile atoms of gold, palladium, sulfur, selenium, or tellurium, and the like to provide increased sensitivity to light and other sensitometric properties. Examples of typical chemically sensitized photographic silver halide emulsions are described in, for example, *Research Disclosure*, Item No. 308119, December 1989, Section III, and *Research Disclosure*, Item No. 36544, September 1994, Section IV and the references listed therein (Research Disclosure is published by Kenneth Mason Publications Ltd., Dudley House, 12 North Street, Emsworth, Hampshire PO10 7DQ, England).

Compounds used as chemical sensitizers have been reviewed by J. M. Harbison and H. E. Spencer (*Chemical Sensitization and Environmental Effects* in The Theory of the Photographic Process, 4th Ed., Macmillan Publishing Co., Inc., N.Y., 1977, pp. 149–160).

Gold(I) compounds with the general formula I have been recently described as a new class of chemical sensitizers of cofiled K. J. Lushington and H. J. Gysling, Docket 74,387 filed simultaneously herewith titled GOLD CHEMICAL SENSITIZERS FOR SILVER HALIDES.

$$\{AuS_2X\}_n \qquad \text{I}$$

X=$PR_2$, $P(OR)_2$, COR, $CNR_2$, CR

R=alkyl, aryl n=1–6

Tellurium(2+) coordination complexes with the general formula II have also been described as chemical sensitizers (U.S. Ser. No. 653,735 filed May 23, 1996).

$$Te(S_2X)_2 \qquad \text{II}$$

X=$PR_2$, $P(OR)_2$, COR, $CNR_2$, CR

R=alkyl, aryl

Palladium (II) coordination complexes with organotellurium ligands and having the general formula III have also been recently described as new chemical sensitizers (U.S. Ser. No.689,325 filed Aug. 7, 1996).

$$Pd(TeR_2)_2X_2 \qquad \text{III}$$

X=halide or pseudohalide

R=alkyl or aryl

Sensitizations of silver halide emulsions are typically carried out by adding a solution of the sensitizing compound to the silver halide emulsion and heating the resulting emulsion at some elevated temperature for a defined time period. Sensitizer compounds which are soluble in water are most commonly used to avoid the use of organic solvents which can have environmental problems. In some cases methanol solutions of sensitizer compounds have also been used for chemical sensitization of silver halide emulsions. Thus, in practical chemical sensitization procedures for silver halide emulsions, useful chemical sensitizer reagents have been restricted to materials which are highly soluble in, ideally, water or methanol. This solubility requirement significantly limits the scope of materials which can be used in practical sensitization procedures of silver halide emulsions. Processes for the chemical sensitization of silver halide emulsions which use aqueous systems are, therefore, of significant practical importance. The availability of a process which would allow essentially any chemical sensitizer reagent to be highly purified by the methods known in the art (e.g., recrystallization and or chromatographic methods) and then introduced into an aqueous media for addition to a silver halide emulsion in a chemical sensitization procedure would be highly desirable.

PROBLEM TO BE SOLVED BY THE INVENTION

There is, therefore, a need for a process in which chemical sensitizers which are of low solubility, in water or environmentally benign solvents such as methanol, can be introduced into aqueous silver halide emulsions in an aqueous phase in a form useful for chemical sensitization of said silver halide emulsion by subsequent finishing procedures well known in the photographic art.

SUMMARY OF THE INVENTION

It is an object of the invention to provide new chemical sensitizers for silver halide emulsions.

It is a further object of this invention to chemically sensitize silver halide emulsions by addition of aqueous solid particle dispersions of inorganic chemical sensitizers which have low solubility in water and organic solvents.

These and other objects of the invention are provided by a method of chemical sensitization comprising providing a silver halide emulsion, and adding to the silver halide emulsion an aqueous solid particle dispersion of a chemical sensitizing agent of low solubility in water or organic solvents and heating said emulsion wherein said chemical sensitizing agent comprises at least one member selected from the group consisting of gold compounds represented by Formula I:

$$\{AuS_2X\}_n \qquad \text{I}$$

wherein

X is $PR_2$ (dithiophosphinates), $P(OR)_2$ (dithiophosphates), COR (xanthates), $CNR_2$ (dithiocarbamates), CR (dithiocarboxylates)

R is alkyl or aryl n=1–6, tellurium compounds represented by Formula II:

$$TeL_nX_2$$

wherein

L is thiourea or substituted thiourea, n is 2 or 4,

X is Cl, Br, I, OCN, SCN, SeCN, TeCN, or $N_3$ and

Formula IIA

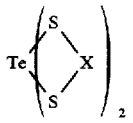

wherein

X is COR, CSR, $CNR_2$, CR, CAr, $PR_2$, $P(OR)_2$, $(PR_2)_2N$

R is alkyl or aryl, and palladium compounds represented by Formula III:

$$PdX_2(TeR_2)_2$$

wherein

X is Cl, Br, I, NCO, NCS, NCSe, TeCN, or $N_3$

R is alkyl or aryl.

ADVANTAGEOUS EFFECTS OF THE INVENTION

An advantage of the invention is the ability to chemically sensitize silver halide emulsions with a broad spectrum of inorganic materials which have low solubility in water or organic solvents (i.e., 50 mg/100 ml or less) and, therefore, cannot be added to said emulsions as conventional homogeneous solutions.

DETAILED DESCRIPTION OF THE INVENTION

While a variety of chalcogenide compounds (i.e., sulfur, selenium, and tellurium compounds) as well as transition metal compounds (e.g, compounds of gold most commonly) have been used to chemically sensitize silver halide emulsions, the addition of such compounds to the silver halide emulsion in the sensitization step is generally carried out using a homogeneous solution of the compound in water or a nonaqueous solvent such as methanol, acetonitrile, or N,N-dimethylformamide. Such chemical sensitizers are generally carefully purified to a high level by methods well known in the art (e.g., recrystallization or various chromatographic techniques). The purified compound is then dissolved in an appropriate solvent, and the resulting solution is added to the silver halide emulsion which is then subjected to a so-called "finishing" in which the emulsion containing the chemical sensitizer is heated to an elevated temperature for some period of time. Typical emulsion finishing conditions are 10–60 minutes at temperatures of 35°–75° C. The use of various chalcogenide compounds and transition metal compounds as chemical sensitizers in such emulsion finishing procedures are well known in the art and are described in, for example, *Research Disclosure*, Item No. 36544, September 1994, Section IV. Other more recently disclosed chemical sensitizers include the following three classes:

1) Gold(1+) complexes of formula I as described in cofiled K. J. Lushington and H. J. Gysling Docket No. 74,387 titled GOLD CHEMICAL SENSITIZERS FOR SILVER HALIDES.
2) Tellurium(2+) coordination complexes with the general formula II and IIA as described in K. J. Lushington and H. J. Gysling, U.S. Ser. No. 08/653,735 filed May 23, 1996.
3) Palladium (II) coordination complexes with organotellurium ligands having the general formula III as described in H. J. Gysling and K. J. Lushington, U.S. Ser. No. 08/689,325 filed Aug. 7, 1996.

The above cited three disclosures hereby incorporated by reference and references contained therein describe chemical sensitization of silver halide emulsions using a wide variety of chalcogenide and transition metal complexes. However, some of the compositions of the above Formulas I, II, IIA, and III are not sufficiently soluble such that they may be added as concentrated solvent solutions. These prior art sensitizations are carried out by dissolving the chalcogenide or transition metal chemical sensitizer in an appropriate solvent such as water or a nonaqueous solvent such as methanol, acetonitrile, or N,N-dimethylformamide and adding the resulting solution to the silver halide emulsion. The above prior art sensitizations utilize homogeneous solutions of the highly purified inorganic reagents and, therefore, are limited to chemical sensitizers which exhibit sufficient solubility in these solvents to allow the preparation of such solutions. There is a need to find a way to sensitize with these compounds without using dilute solutions.

Research Disclosure, 37154, of March 1995, an exception to this general use of homogeneous solutions of chemical sensitizers uses aqueous dispersions of gold sulfide for chemical sensitization. The use of such aqueous dispersions of gold sulfide for chemical sensitizations suffers from poor process reproducibility due to the fact such dispersions are prepared in-situ, that is, the aurous sulfide is formed in aqueous gelatin by a chemical reaction between some soluble gold salt and a suitable sulfur reagent. Such a preparative procedure, which directly precipitates the gold sulfide in situ to give an aqueous dispersion of this material, does not provide material of high purity, and the chemical composition of such sensitizer dispersions is subject to variability depending on the conditions of carrying out the precipitation of the gold sulfide.

There is a need, therefore, for a process to introduce highly purified chemical sensitizers, which are insoluble in water and suitable organic solvents, into a silver halide emulsion for finishing said emulsions to give chemically sensitized emulsions of high photographic speed. By "suitable organic solvents" is meant organic solvents which are miscible with water and are environmentally benign. While solvents used for this purpose have included methanol, acetonitrile, and N,N-dimethyl-formamide, for practical purposes current manufacturing technology for silver halide emulsions restricts the solvents useful for the introduction of emulsion addenda to water and methanol. There is, therefore, a need for methods to introduce into silver halide emulsions highly pure, molecular compounds used as chemical sensitizers which are substantially insoluble in water and methanol.

This invention provides a process for chemically sensitizing a silver halide emulsion using an environmentally benign aqueous gelatin solid particle dispersion containing highly purified chemical sensitizers that are substantially insoluble in water and methanol. The invention is particularly preferred for chemical sensitizers having a solubility in water or methanol of less than 50 mg/100 ml at20° C. Such dispersions can be prepared by milling an aqueous slurry of ca. 2% by weight of the chemical sensitizer reagent with a suitable surfactant, the concentration of said surfactant typically being about 36 weight percent of the chemical sensitizer.

Aqueous, solid particle dispersions of insoluble chemical sensitizers are prepared by milling an aqueous slurry of chemical sensitizer and surfactant using techniques such as described in Paint Flow and Pigment Dispersion by T. C. Patton (Second Edition, Wiley Interscience, New York, 1979). The type of milling technique chosen should be capable of producing an end product in which the chemical sensitizer particles are less than 1 micron in diameter. The ball mill and SWECO Vibro-Energy Mill (SWECO Inc., Los Angeles, Calif.) are examples of suitable milling devices. Examples of the application of these and related milling devices to the formation of solid particle dispersions of other photographic chemicals can be found in the *Research Disclosure*, February 1995, Item 37018 published by Kenneth Mason Purblications, Ltd., Dudley House, 12 North Street, Emsworth, Hampshire PO10 7DQ, ENGLAND.

In practice, the milling device is charged with the solid chemical sensitizer of interest, surfactant, water, and milling media. The concentration of the chemical sensitizer in the aqueous slurry should be 1 to 20%. The surfactant must be compatible with silver halide photographic elements. A wide range of anionic surfactants may be used with a purified version of the alkylated aryl polyether sulfonate called Triton® X-200 (Rohm and Haas, Philadelphia, Pa.) being the preferred choice. The weight ratio of surfactant to chemical sensitizer can be 0.01 to 1, with 0.05 to 0.5 being preferred. The water may be distilled or regular tap water with the former preferred. In addition to the above components, the aqueous slurry may also contain other surfactants or polymers. The milling media can be constructed of a variety of materials such as glass, plastic, metals, or ceramics with zirconium oxide being preferred for the ball mill and SWECO mill mentioned above. Size and shape can be varied but preferred are 1–2 mm diameter spheres. In the case of the ball mill, the amount of media is roughly half the volume of the milling vessel used. The amount of aqueous slurry is just sufficient to cover the media bed. For the roller mill and 2 mm zirconium oxide media, the weight ratio of aqueous phase to media was 0.12. For the SWECO mill a ratio of 0.18 was used.

The aqueous slurry components and milling media can be introduced to the milling device in any order or pre-blended. The milling temperature can be varied but is most easily performed at ambient (>30° C.) conditions. Milling time depends on the device but is roughly one to eight days.

Following milling, the slurry is separated from the milling media by coarse filtration. The resulting slurry can be used as is or can be diluted with hydrophilic polymer (preferably gelatin) to form a solid particle dispersion. Alternately, the separation of the media from the product can be delayed until the dilution has been performed. The preferred polymer gelatin can have originated from bone or skin source with processing by either acid or base hydrolysis.

Particle size of the final dispersion is judged by light microscopy. Sonification can be used to break up aggregates of particles.

The complexes of the invention may be utilized in any suitable amount. Typically the gold compounds would be utilized in an amount between about 0.01 and 100 μmol/mol Ag. Preferably they would be utilized in an amount between about 0.1 and 50 μmol/mol Ag for best sensitization.

The preferred compounds of the invention are $\{AuS_2P(i\text{-}Bu)_2\}_2$, $\{AuS_2CNEt_2\}_2$, $\{AuS_2CN(n\text{-}Bu)_2\}_2$, $\{AuS_2COC_5H_{11}\}_2$, $Te\{S_2COC_{10}H_{21}\}_2Te\{(SPPh_2)_2N\}_2$, $PdCl_2\{Te(CH_2SiMe_3)_2\}_2$, $Pd(SCN)_2\{Te(CH_2SiMe_3)\}_2$.

The complexes of the invention may be added to a silver halide emulsion at various stages during emulsion preparation and finishing. The gold compounds may be added during emulsion formation, or they may be added after emulsion formation and after washing of the emulsion. They may be added prior to a heat cycle for chemical sensitization or they may be added during the heat cycle after the emulsion has been brought to an increased temperature. It is preferred that they be added either prior to or during the sensitization cycle. The heat cycle is preferably carried out at a temperature of between about 30° and 90° C. with a preferred temperature of addition being between 40° and 70° C. The addition may take place prior to heating or after heating has taken place. The sensitizing compounds of the invention may be added singly or in combination with other sensitizing agents. They also may be added to a silver halide emulsion along with silver ion ligands and silver halide growth modifiers or stabilizers and the antifogging agents. Further, the complexes of the invention may be added with other chemical sensitizing agents such as sulfur, selenium or tellurium, or other noble metal compounds such as those of palladium, platinum, rhodium, or iridium compounds or with dopants such as iron, iridium, rhodium, ruthenium, or osmium complexes. The sensitizers of the invention may be added during formation of silver halide grains, during the physical or chemical ripening stage, or in a separate step immediately prior to coating to form a photographic element. The gold sensitizers may be added in the presence of spectral sensitizing dyes and other organic addenda.

This invention provides a process for chemical sensitizing a silver halide emulsion formed according to any of the processes generally well known in the art. A double jet-type process is preferred. The silver halide grains can comprise mixed or single halide components and especially include chloride, bromide, iodide, iodochloride, iodobromide or chlorobromide grains. They can also be different morphologies such as cubic, tabular, core shell, or tetradecahedral.

The double-jet process comprises adding an aqueous silver nitrate solution and an aqueous solution of one or more halides, for example, an alkali metal halide such as potassium bromide, potassium chloride, potassium iodide or mixtures thereof, simultaneously to a stirred solution of a silver halide protective colloid through two separate jets.

Gelatin is preferred as the binder or protective colloid for the photographic emulsion of the present invention. However, other hydrophilic colloids are also suitable. For example, proteins such as gelatin derivatives, graft polymers of gelatin and other polymers, albumin, casein, cellulose derivatives such as hydroxyethyl cellulose, carboxymethyl cellulose and cellulose sulfate, sugar derivatives such as sodium alginate, starch derivatives and various synthetic peptizers such as hydrophilic homopolymers or copolymers such as polyvinyl alcohol, poly-N-vinylpyrrolidone, polyacrylic acid, polymethacrylic acid, polyacrylamide, polyvinylimidazole and polyvinyl pyrazole can be used. Acid-processed gelatin can be used, as well as lime-processed gelatin. Further, gelatin hydrolyzates and enzyme-hydrolyzed products of gelatin are also usable.

Surface-active agents may be incorporated in a photographic emulsion layer or in another hydrophilic colloid layer as a coating aid to prevent buildup of static charge, to improve lubrication properties, to improve emulsion dispersion, to prevent adhesion and to improve other properties.

A photosensitive material of the present invention may contain antifogging agents or emulsion-stabilizing agents such as, for example, azaindenes, disulfides, thionamides, azoles and the like.

The photographic silver halide emulsions as described can be used in photographic silver halide elements in any of the ways and for purposes known in the photographic art.

The photographic silver halide emulsions can be used and incorporated in photographic elements that are black and white, single color elements or multicolor elements. Multicolor elements contain dye image-forming units sensitive to each of the three primary regions of the visible spectrum.

Each unit can be comprised of a single emulsion layer or of multiple emulsion layers sensitive to given regions of the spectrum. The layers of the element can be arranged in various orders as known in the art.

In the following discussion of suitable materials for use in emulsions and elements of the invention, reference will be made to *Research Disclosure*, Number 36544 of September 1994. *Research Disclosure* is published by Kenneth Masons Publications Ltd., Dudley House, 12 North Street, Emsworth, Hampshire PO10 7DQ, England. This publication will be identified hereafter by the term "Research Disclosure".

The silver halide emulsions of the invention can be used in elements that can be either negative-working or positive-working. The emulsions in which the described new chemical sensitizers can be used are described in, for example, *Research Disclosure* Sections I, II and III and the publications and patents cited therein. Useful vehicles for the emulsion layers and other layers of elements of the invention are described in *Research Disclosure* Section IX and the publications cited therein.

The described photographic emulsions can be used in color photographic elements with couplers as described in *Research Disclosure* Section X and the publications cited therein. The couplers can be incorporated in the elements and emulsions as described in *Research Disclosure* Section XI and ways known in the art.

The photographic elements and emulsions as described can contain addenda known to be useful in photographic elements and emulsions in the photographic art. The photographic elements and emulsions as described can contain, for example, brighteners (see *Research Disclosure* Section VI); antifoggants and stabilizers (see *Research Disclosure* Section VII); antistain agents and image dye stabilizers (see *Research Disclosure* Section X); light absorbing and scattering materials (see *Research Disclosure* Section II); hardeners (see *Research Disclosure* Section IX); coating aids (see *Research Disclosure* Section IX); plasticizers and lubricants (see *Research Disclosure* Section IX); antistatic agents (see *Research Disclosure* Section IX); matting agents (see *Research Disclosure* Section IX); and development modifiers (see *Research Disclosure* Section XVIII).

The photographic silver halide materials and elements as described can be coated on a variety of supports as described in *Research Disclosure* Section XV and the publications cited therein.

The photographic silver halide materials and elements as described can include coarse, regular and fine grain silver halide crystals or mixtures thereof and can be comprised of any photographic silver halides known in the photographic art.

The photographic silver halide materials as described can be spectrally sensitized by means and dyes known in the photographic art, such as by means of spectral sensitizing dyes as described in, for example, *Research Disclosure* Section V and the publications cited therein. Combinations of spectral sensitizing dyes are especially useful.

Photographic materials and elements as described can be exposed to actinic radiation, typically in the visible region of the spectrum, to form a latent image as described in *Research Disclosure* Section XVI and then processed to form a visible image as described in, for example, *Research Disclosure* Section XVIII using developing agents and other processing agents known in the photographic art Processing to form a visible image, typically a dye image, includes the step of contacting the element with a developing agent, typically a color developing agent, to reduce developable silver halide and oxidize the developing agent. In a color material the oxidized color developing agent in turn reacts with couplers to yield a dye.

The photographic silver halide materials can also be used in physical development systems as described in *Research Disclosure* Section XVII, in image-transfer systems as described in *Research Disclosure* Section X, in dry development systems as described in *Research Disclosure* Section XVII and in printing and lithography materials as described in *Research Disclosure* Section XIX.

The photosensitive materials obtained by the present invention can be processed according to known methods. A developer to be used for the black-and-white processing can contain conventional developing agents such as dihydroxybenzenes (e.g., hydroquinone), 3-pyrazolidones (e.g., 1-phenyl-3-pyrazolidone), amino-phenols. (e.g., N-methyl-p-amino-phenol), 1-phenyl-3-pyrazolidones or ascorbic acids.

As color-developing agent, there can be used primary aromatic amine developing agents such as phenylenediamines (e.g., 4-amino-N,N-diethylaniline, 3-methyl-4-amino-N,N-diethylaniline, 4-anmino-3-methyl-N-hydroxyethylaniline, 3-methyl-4-amino-N-ethyl-N-hydroxyethylaniline, 3-methyl-4-amino-N-ethyl-N-methanesulfonamido-ethylaniline and 4-amino-3-methyl-N-ethyl-N-methoxyethylaniline. In addition, the developing agents described in L. F. A. Mason, *Photographic Processing Chemistry* (Focal Press, 1966), pp. 226–229, as well as those described in U.S. Pat. Nos. 2,193,015 and 2,592,364 may be used.

A photographic emulsion useful in the present invention can be applied to many different silver halide photographic light-sensitive materials due to its high photographic sensitivity, contrast, and fog reduction. For example, it can be used in high speed black-and-white negative films, in X-ray films and in multilayer color negative films. Addenda such as antifoggants and spectral sensitizers may be present during chemical sensitization with the invention materials.

The invention is particularly suitable for use with tabular silver bromoiodide grains which find their preferred use in color negative films. In such films it is particularly important that higher speeds be obtained, as there is a continuing need for higher speed films for color negative photography.

The gold compounds are generally formed, for example, by the techniques disclosed in J. B. Miller and J. L. Burmeister, Synth. React. Inorg. Met.-Org. Chem., 15, 223 (1985).

The gold(I) compounds of this invention can be prepared by reaction of an alkali metal salt of the appropriate 1,1-dithio anionic ligand with either a Au(3+) salt, e.g., $C\{AuCl_4\}$(C=H, Na, K, $NH_4$) or a Au(I)salt, e.g., $C\{AuCl_2\}$. In the former case excess ligand is needed in the reaction since it must function both as a reducing agent for the Au(3+)–>Au(1+) reduction, as well as a ligand for the final Au(1+).

Since simple Au(I) salts are unstable with respect to decomposition by a disproportionation reaction, suitable Au(I) starting materials must be stabilized to allow their use in the preparative procedure for the compounds of this invention. The useful Au(I) starting materials can be Au(I) compounds sufficiently stabilized by ligands to allow their isolation as stable solids. Such complexes include AuClL (L=$Me_2S$: F. Bonati and G. Minghetti, Gazz. Chim. Ital., 103, 373(1973); tetrahydrothiophene: R. Uson, A. Laguna, and M. Laguna, Inorg. Synth., 26 85(1989), 2,2'-thiodiethanol (thiodiglycol): A. K. Al-Sa'ady, C. A. McAuliffe, R. V. Parish, and J. A. Sandbank, Inorg. Synth., 23, 191(1985)), and $\{AuL_2\}BF_4$(L=thiourea: G. Marcotrigiano, R. Battistuzzi, and G. Peyronel, Inorg. Nucl. Chem. Lett., 8, 399(1972); L=pentamethylenesulfide: D. T. Hill, U.S. Pat. No. 4,165,380(1979)). The stabilizing organic ligands incorporated in such starting materials must be sufficiently good ligands to allow the isolation of solid Au(I) compounds that have reasonable stability but must not be too tightly coordinated to the Au(I) to prevent their facile displacement from the Au(I) coordination sphere upon reaction with the 1,1-dithio anionic ligands of this invention to produce the desired $AuS_2X$.

Alternatively, metastable Au(1+) complexes can be generated in-situ from Au(3+) salts by suitable reducing agents, generally at low temperatures and in the presence of excess stabilizing ligand to allow the formation of labile Au(1 +) intermediates which can be reacted soon after their formation in solution with the 1,1,-dithio anionic ligands without actual isolation of a Au(1 +) reagent. A useful synthetic procedure of the latter type is the in-situ formation of the metastable Au(1 +) complex, $\{AuCl_2\}(1-)$, by the sodium sulfite reduction of a Au(3+)chloro complex, $C\{AuCl_4\}$(C=$NH_4$, Na, K) in a saturated aqueous sodium chloride at low temperature (e.g., ca. 0°–10° C.), followed by reaction of this metastable $\{AuCl_2\}(1-)$ with a water soluble salt of a 1,1-dithio type anion (see H. J. A. Blaauw, R. J. F. Nivard, and G. J. M. van der Kerk, J. Organometal. Chem., 2, 236(1964) and J. B. Miller and J. L. Burmeister, Synth. React Inorg. Met.-Org. Chem., 15, 223(1985): The Synthesis of Dialkyldithiocarbamatogold(I) Dimers). The in-situ reduction of the Au(3+) complex, $\{AuCl_4\}(1-)$, to the Au(1+) complex, $\{AuCl_2\}(-1)$, is accompanied by a color change from bright yellow to colorless. When the completion of the in-situ reduction is evidenced by the complete decolorization of the initial $C\{AuCl_4\}$ solution, an aqueous solution of the appropriate 1,1-dithio type anion is immediately added to form the desired $AuS_2X$ compound. The resulting $AuS_2X$ product, in some cases, may precipitate from the solution allowing its isolation by filtration and purification by washing well with water (and in some cases followed by ethanol and ethyl ether) and subsequent drying and recrystallization from an appropriate solvent In other cases the desired product can be isolated by extraction of the aqueous reaction solution with an immiscible organic solvent such as toluene, methylene chloride, etc., followed by drying of the resulting non-aqueous solution of the desired product and isolation of the solid $AuS_2X$ product by concentration of the solution volume. The resulting isolated $AuS_2X$ product can then be further purified by recrystallization from an appropriate organic solvent.

Although the formula of complexes of Formula I, this invention can be written as $\{AuS_2X\}$, the actual structure may be dimeric, trimeric, or higher in degree of association. A single crystal X-ray diffraction studies of the Au(I) complex of the nominal formula $AuS_2P(i\text{-}Bu)_2$, prepared in this work, for example, has shown that this complex is dimeric with two di(iso-butyl)dithiophosphinate ligands bridging a pair of Au(1 +) ions, with each gold having linear two-coordination. Preferred Formula I compounds are $\{AuS_2P(i\text{-}Bu)_2\}_2$, $\{AuS_2CNBu_2\}_2$, $\{AuS_2CNEt_2\}_2$, and $\{AuS_2COC_5H_{11}\}_2$.

The tellurium compounds of Formulas II and IIA of the invention have numerous advantages over prior materials. The Te(II) coordination complexes of this invention give improved sensitization compared to prior art tellurium sensitizers. The Te(II) coordination complexes of this invention exhibit enhanced stability under ambient keeping conditions compared to prior art tellurium sensitizers. The Te(II) coordination complexes of this invention can be prepared in high yields by convenient synthetic procedures.

Tellurium (II) coordination complexes of Formulas II and IIA with monodentate and bidentate sulfur ligands have been described in the open literature:

(a) O. Foss, Pure Appl. Chem., 24, 31(1970)

(b) S. Husebye, Phosphorus and Sulfur, 38, 271(1988)

(c) I. Haiduc, R. B. King, and M. G. Newton, Chem. Rev., 94,301(1994).

Any tellurium compound as set forth in Formula II or Formula IIA is a suitable sensitizer. The preferred sensitizers have been found to be the Formula IIA compounds because of their increased stability under ambient conditions compared to sensitizers of Formula II. The most preferred compounds are the following Formula IIA compounds that provide a dramatic increase in sensitization, are low in cost, and stable: $Te\{(SPPh_2)_2N\}_2$, $Te(S_2COC_{12}H_{25})_2$.

The palladium compounds of Formula III of the invention have numerous advantages over prior materials. The Pd(II) coordination complexes of this invention give improved sensitization compared to prior art palladium sensitizers. The Pd(II) coordination complexes of this invention exhibit enhanced stability under ambient keeping conditions compared to prior art palladium sensitizers. The Pd(II) coordination complexes of this invention can be prepared in high yields by convenient synthetic procedures.

The chemical sensitizers of this invention provide new silver halide chemical sensitizers which incorporate a noble metal and 1 or more chalcogen atoms in one molecular species. Such compositions can be considered as "single source sensitizers" analogous to "single source precursors" recently described as molecular reagents for the MOCVD fabrication of thin films of electronic materials such as 3–5 semiconductors (e.g., see A. H. Cowley and R. J. Jones, Polyhedron, 13, 1149 (1994)).

The new chemical sensitizers of this invention can be purified by recrystallization to give crystalline solids of high purity which can be introduced into a silver halide emulsion in the finishing step as an aqueous dispersion.

The palladium compounds are generally formed by the techniques disclosed in H. J. Gysling, Coord. Chem. Rev., 42, 163–175 (1982) and references therein.

The palladium complexes of this invention provide rapid chemical sensitization as a result of their lack of interaction with gelatin, a common problem for prior art palladium compounds.

Any palladium compound as set forth in Formula III is a suitable sensitizer.

Typical compounds of the Formula III suitable for the invention are listed below.

$PdCl_2\{Te(CH_2SiMe_3)_2\}_2$ $Pd(SCN)_2\{Te(CH_2SiMe_3)_2\}_2$

EXAMPLES

EXAMPLE 1

SYNTHESIS OF $\{AuS_2CN(n\text{-}C_4H_9)_2\}_2$ $K\{AuCl_4\}$(3.8 g, 10 mmoles) was dissolved in 200 ml of a saturated aqueous NaCl solution (ca. 70 g NaCl/200 ml $H_2O$). The resulting solution was cooled to −10° C. and to it was added a solution of 1.64 g (13 mmoles) of $Na_2SO_3$ dissolved in 140 ml of water. The initial bright yellow solution became colorless in ca. 30 seconds, and 13 ml of a 2.2 M aqueous solution of $NaS_2CN(n\text{-}C_4H_9)_2$ was immediately added. The initial heavy yellow precipitate that formed became a pale green oil on stirring the reaction solution for 30 min. and the product was then extracted with 3–300 ml portions of methylene chloride. The combined $CH_2Cl_2$ extracts were washed with 2–200 ml portions of water and the resulting green-black $CH_2Cl_2$ solution was then dried over $MgSO_4$ and the solvent was removed on a rotary evaporator to give a black oil. Dissolution of his oil in 100 ml of ether and cooling of the resulting solution to −78° C. gave a bright yellow precipitate which was filtered, washed with ether and vacuum dried to give 2.3 g of crude product. Recrystallization of this product from 400 ml of hot 1:1 methanol-$CH_2Cl_2$ gave 1.9 g of orange needles (47%: Calcd. (found) for $C_9H_{18}AuNS_2$(MW=401.35): C, 26.93(26.68); H, 4.52(4.36); S, 15.98(15.62); m.p. 161° C. (DSC).

EXAMPLE 2

SYNTHESIS OF $\{AuS_2CNEt_2\}_2$

This compound was prepared by the same general procedure described in Example 3. The initial product, isolated as a bright yellow powder (3.3 g), was recrystallized from 450 ml N,N-dimethylformamide (120° C.) to give a crop of fibrous, pale orange needles (2.6 g; Calcd. (Found) for $C_5H_{10}AuNS_2$(MW=345.24): C, 17.40(17.59); H, 2.92 (2.54); S, 18.58(18.10)). The field desorption mass spectrum of this compound gave an intense peak at 690, corresponding to the dimeric structure.

EXAMPLE 3

SYNTHESIS OF $AuS_2COCH_2CH_2S(n\text{-}C_3H_7)$

This compound was prepared by the general route outlined in Example 3 (using 10 mmoles of $K\{AuCl_4\}$ and 14 mmoles (3.28g) of $K\{S_2COCH_2CH_2S(n\text{-}Pr)\}$, which was prepared from $HOCH_2CH_2S(n\text{-}Pr)+CS_2+KOH$ as described in S. Ramachandra Rao, "Xanthates and Related Compounds", Marcel Dekker, Inc., N.Y., 1971)). The initial product, isolated as an orange powder (3.8 g), was purified by recrystallization from 600 ml of $CH_2Cl_2$ to give 2.1 g of bright yellow crystals (Calc. (Found) for $C_6H_{11}AuOS_3$ (MW=392.32): C, 18.37(18.24); H, 2.83(2.66); S, 24.52 (24.87)).

EXAMPLE 4

PREPARATION OF AN AQUEOUS SOLID PARTICLE DISPERSION OF $\{AuS_2CNEt_2\}_2$

Into a 60-mL brown, glass bottle was placed 0.5 g of $[AuS_2CNEt_2]_2$, 2.65 g of a 6.8% Triton® X-200 (Rohm and Haas, Philadelphia Pa.) also containing 34 mL/L 2N propionic acid, 22.18 g of distilled water, and 137 g of 2 mm zirconium oxide milling media. The bottle was capped and mounted on the SWECO mill and agitated for four days at room temperature. Following milling, the bottle and contents were warmed to 45° C. and added with good agitation to 24.67 g of a 12.16% solution of deionized, lime-processed bone gelatin. This mixture was run through a coarse mesh sieve to separate the media. Nominal content of the final dispersion was 1.0% $[AuS_2CNEt_2]_2$ and 6.0% gelatin. Examination by light microscopy shows well-dispersed particles of average diameter less than 1 micron.

EXAMPLE 5

SENSITIZATION OF A RUN-DUMP TABULAR EMULSION WITH THE GOLD COMPLEXES OF THIS INVENTIONS

A tabular silver bromoiodide emulsion with a 1.4 μm equivalent circular diameter and a thickness of 0.12 μm and a 1.5% I run and 3% I dump was prepared as taught in B. R. Johnson and P. J. Wrightman, U.S. Pat. No. 5,164,292 (1992). This emulsion was then treated with the aqueous solid particle dispersions at a variety of levels at a temperature of 65° C. for 20 minutes as shown in TABLE 1. Once the chemical digestion was complete, the example emulsions were cooled and coated on a film support at 1614 mg Ag $m^{-2}$ and 3230 mg gel $m^{-2}$. A 1614 mg gel $m^{-2}$ overcoat was applied over the emulsion containing layers. The coatings were then dried and exposed (0.1s, 365 nm source) through a graduated density step wedge, processed (6 minutes at 20° C.) in KODAK Rapid X-ray Developer, washed, and dried. Speeds, expressed as the relative exposure required to increase the measured density to 0.15 above fog, are given in Table 1.

TABLE 1

Sensitometric Results for AgBrI Run-Dump Tabular Emulsions Sensitized with Compounds of this invention as Aqueous Solid Particle Dispersions (held 20 minutes at 65° C.)

| Solid Particle Dispersion | Level μmole/mole Ag | Relative Speed |
|---|---|---|
| check (primitive) | — | 100 |
| $\{AuS_2CN(n\text{-}Bu)_2\}_2$ | 5 | 191 |
| $\{AuS_2COC_5H_{11}\}_2$ | 5 | 131 |
| $\{AuS_2CNEt_2\}_2$ | 40 | 741 |
| $Te\{(SPPh_2)_2N\}_2$ | 20 | 427 |

EXAMPLE 6

SENSITIZATION OF MONODISPERSE AgBr TABULAR EMULSIONS

A tabular monodisperse silver bromide emulsion (Emulsion 2) with an equivalent circular diameter of 2.4 μm and a thickness of 0.138 μm was prepared as taught in U.S. Pat. No. 5,147,771. This emulsion was then treated with 10 μmoles/mole Ag of an aqueous solution of $Na_2S_2O_3.5H_2O$ followed by the addition of the aqueous solid particle dispersion at a level of 10 μmoles/mole Ag at a temperature of 65° C. for 20 minutes as shown in Table 2. Once the chemical digestion was complete, the example emulsions were cooled and coated on a film support at 1614 mg Ag $m^{-2}$ and 3230 mg gel $m^{-2}$. A 1614 mg gel $m^{-2}$ overcoat was applied over the emulsison containing layers. The coatings were then dried and exposed (0.1s, 365 nm source) through a graduated density step wedge, processed (6 minutes at 20° C.) in KODAK Rapid X-ray Developer, washed, and dried. Speeds obtained with these films, expressed as the relative exposure required to increase the measured density to 0.15 above fog, are given in Table 2.

TABLE 2

Sensitometric Results For AgBr Tabular Emulsions Sensitized With 10 μmole/mole AgX of $Na_2S_2O_3$ + 10 μmole of Compounds of this invention as Aqueous Solid Particle Dispersions (held 20 minutes at 65° C.)

| Gold Compound | Gold Sensitizer Form | Relative Speed |
|---|---|---|
| Control (no sensitization) | none | 100 |
| $S_2O_3$ only (comparison) | none | 446 |
| $\{AuS_2P(i\text{-}C_4H_9)_2\}_2$ | solid particle dispersion | 1350 |
| $\{AuS_2CN(C_2H_5)_2\}_2$ | solid particle dispersion | 590 |

The invention has been described in detail with particular reference to certain preferred embodiments thereof, but it will be understood that variations and modifications can be effected within the spirit and scope of the invention.

What is claimed is:

1. A method of chemical sensitization comprising providing a silver halide emulsion, and adding to the silver halide emulsion aqueous solid particle dispersion of a chemical sensitizing agent of low water and organic solvent solubility, and heating said emulsion wherein said chemical sensitizing agent comprises at least one member selected from the group consisting of gold compounds represented by Formula I:

$$\{AuS_2X\}_n \quad \text{I}$$

wherein

X is $PR_2$ (dithiophosphinates), $P(OR)_2$ (dithiophosphates), COR (xanthates), $CNR_2$ (dithiocarbamates), CR (dithiocarboxylates)

R is alkyl or aryl n=1–6, tellurium compounds represented by Formula II:

$$TeL_nX_2$$

wherein

L is thiourea or substituted thiourea, n is 2 or 4,

X is Cl, Br, I, OCN, SCN, SeCN, TeCN, or $N_3$ and Formula IIA

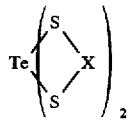

wherein

X is COR, CSR, $CNR_2$, CR, CAr, $PR_2$, $P(OR)_2$, $(PR_2)_2N$

R is alkyl or aryl, and palladium compounds represented by Formula III:

$$PdX_2(TeR_2)_2$$

wherein

X is Cl, Br, I, NCO, NCS, NCSe, NCTe, or $N_3$

R is alkyl or aryl.

2. The method of claim 1 wherein said sensitizing agent comprises gold compounds represented by Formula I:

$$\{AuS_2X\}_n \quad \text{I}$$

wherein

X is $PR_2$ (dithiophosphinates), $P(OR)_2$ (dithiophosphates), COR (xanthates), $CNR_2$ (dithiocarbamates), CR (dithiocarboxylates)

R is alkyl or aryl n=1–6.

3. The method of claim 1 wherein said sensitizing agent comprises tellurium compounds represented by Formula II:

$$TeL_nX_2$$

wherein

L is thiourea or substituted thiourea, n is2or4,

X is Cl, Br, I, OCN, SCN, SeCN, TeCN, or $N_3$ and Formula IIA

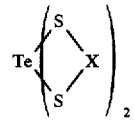

wherein

X is COR, CSR, $CNR_2$, CR, CAr, $PR_2$, $P(OR)_2$, $(PR_2)_2N$

R is alkyl or aryl.

4. The method of claim 1 wherein said sensitizing agent comprises palladium compounds represented by Formula III:

$$PdX_2(TeR_2)_2$$

wherein

X is Cl, Br, I, NCO, NCS, NCSe, NCTe, or $N_3$

R is alkyl or aryl.

5. The method of claim 1 wherein said sensitizing agent is selected from the group consisting of $\{AuS_2P(i\text{-}Bu)_2\}_2$, $\{AuS_2CNEt_2\}_2$, $\{AuS_2CN(n\text{-}Bu)_2\}_2$, $\{AuS_2COC_5H_{11}\}_2$, $Te(S_2COC_{10}H_{21})_2$, $Te\{(SPPh_2)_2N\}_2$, $PdCl_2\{Te(CH_2SiMe_3)_2\}_2$, $Pd(SCN)_2\{Te(CH_2SiMe_3)_2\}_2$.

6. The method of claim 1 wherein the amount of the sensitizer compound is $1\times10^{-8}$ to $1\times10^{-2}$ mol/mol Ag.

7. The method of claim 1 wherein the solid particle size is less than 1 micron.

8. The method of claim 1 wherein the solid particle dispersion is a solid particle gelatin dispersion prepared by mixing the chemical sensitizer compound with a surfactant, an aqueous phase and a milling media to form a slurry, milling the slurry, filtering out the milling media, and mixing the remaining slurry with gelatin.

9. The method of claim 1 wherein the surfactant is an alkylated aryl polyether sulfonate.

10. The method of claim 1 wherein the silver halide emulsion is a silver bromoiodide emulsion.

11. The method of claim 1 wherein said chemical sensitizing agent is substantially insoluble.

12. The method of claim 1 wherein said chemical sensitizing agent has a solubility of less than 50 mg/100 ml in water or methanol at 20° C.

* * * * *